US007257915B1

(12) United States Patent
Lovett et al.

(10) Patent No.: US 7,257,915 B1
(45) Date of Patent: Aug. 21, 2007

(54) DISPLAY SYSTEM FOR A GASOLINE PUMP AND METHOD OF USE

(76) Inventors: Christine A Lovett, 738 Tierney Ave., Ventura, CA (US) 93003; Lawrence A Lovett, 738 Tierney Ave., Ventura, CA (US) 93003

( * ) Notice: Subject to any disclaimer, the term of this patent is extended or adjusted under 35 U.S.C. 154(b) by 391 days.

(21) Appl. No.: 10/961,555

(22) Filed: Oct. 8, 2004

(51) Int. Cl.
*G09F 23/00* (2006.01)

(52) U.S. Cl. ..... 40/609

(58) Field of Classification Search ..... 40/609, 40/792, 794; 206/39.5; 221/2, 197, 281, 221/286

See application file for complete search history.

(56) References Cited

U.S. PATENT DOCUMENTS 110,962 A * 1/1871 Adams ..... 217/114
3,685,184 A * 8/1972 Snyder, Jr. ..... 40/609
4,285,443 A * 8/1981 Winans ..... 221/155
4,432,151 A * 2/1984 Morris ..... 40/661
4,592,530 A * 6/1986 Seely et al. ..... 248/475.1
4,790,089 A * 12/1988 Astolfi ..... 40/792
4,899,886 A * 2/1990 Johansen ..... 206/555
5,366,378 A * 11/1994 Johannsen et al. ..... 434/187
5,370,265 A * 12/1994 Mackay et al. ..... 221/279
6,186,465 B1 * 2/2001 Clark ..... 248/444.1
D523,484 S * 6/2006 Lovett et al. ..... D20/10

* cited by examiner

*Primary Examiner*—Lesley D. Morris
*Assistant Examiner*—Christopher E Veraa
(74) *Attorney, Agent, or Firm*—Ted Masters

(57) ABSTRACT

A display system which is mounted on top of a gasoline pump includes a housing having a plurality of display stations. A display module containing replaceable advertising information is installable at each display station, the display module including a business card dispenser. The display module is installed in the housing via a back panel in the housing. A resilient spacer is installed behind each display module to urge the display module toward the front of the housing.

14 Claims, 6 Drawing Sheets

20
22
34
36
502
30
24
26
32

20
24
28
30
32
34
36
38
39
40
42
44
23
15
502

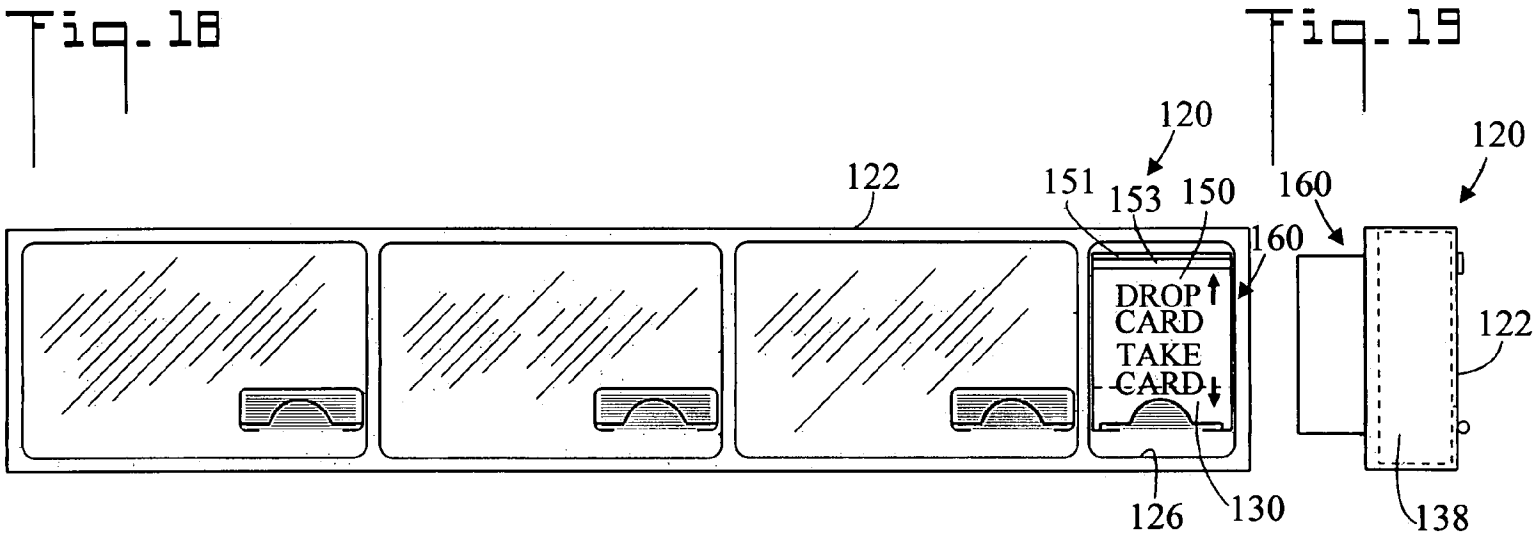
Fig. 19
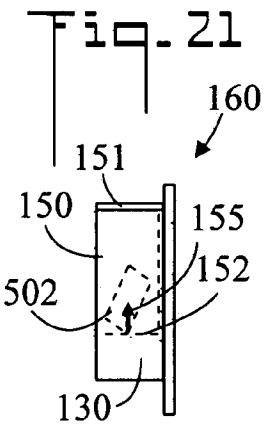
Fig. 21
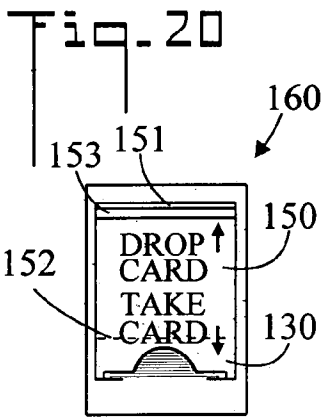
Fig. 20
Fig. 18

DISPLAY SYSTEM FOR A GASOLINE PUMP AND METHOD OF USE

TECHNICAL FIELD

The present invention pertains generally to advertising, and more particularly to an advertising display system which mounts on top of a service station gasoline pump.

BACKGROUND OF THE INVENTION

Display devices are often placed on top of service station gasoline pumps. The devices can display a variety of advertising material such as gasoline prices, service station promotions, special offers, and the like. Since drivers must spend several minutes servicing their vehicles, the top of the gasoline pump affords an excellent marketing opportunity. Such gasoline pump display devices are known in the art. For example, U.S. Pat. Nos. 4,648,169 and 4,592,530 shows an adjustable, universal mounting bracket and system for securing signs and poster display devices to the top of gasoline pump fixtures without the need to drill holes or use adhesives. The mounting bracket may be readily assembled from selected components of a kit to fit many, if not all, popular makes and models of gas pumps. For economical merchandising, one kit fits all and the components of the kit are compactly stored and shipped disassembled. Unused components are thrown away.

U.S. Pat. No. 4,144,664 illustrates a weatherproof display device for changeable display signs to be mounted on a gasoline dispensing pump comprising a transparent weatherproof cover for holding changeable printed display cards depicting the prices and taxes applicable to the gasoline being dispensed. The device includes a thin rectangular box assembly formed by interlocking front and back panels made of a transparent material having a base assembly forming a mounting pedestal and a secured cap forming its top edge and serving as its cover. Insertion and withdrawal of the price display cards is accomplished by lifting the thin rectangular box assembly from its mounting pedestal base assembly, each of which is printed permanently with a specific set of price and tax conditions. The dimensions of each display card conform substantially to the height and width of the transparent panels, and are duplicated so as to be visible from each side. Several display cards, indicating various combinations of prices and taxes, and combined in a booklet form, may be stored safely within the display box, readily available for rearrangement as desired. The display unit may be disassembled rapidly for cleaning purposes.

U.S. Pat. No. 3,882,618 discloses an advertising and display device for use with a gasoline pump. The device is locked to the top of the pump by a support assembly held in place by removable front and rear window assemblies provided with the pump.

U.S. Pat. No. 3,740,881 comprises a display assembly having a vertical panel having horizontal guides between which removable display placards are held and a base which holds the panel in the upright position during normal wind conditions.

U.S. Pat. No. 3,719,000 describes a placard holding display assembly which includes two frames, one telescoped inside the other. An upper frame holds a display placard and can be adjustably raised and lowered to accommodate display placards of various sizes.

U.S. Pat. No. 3,685,184 depicts a display device for exhibiting advertising material on and object, such as a gasoline pump, wherein there is provided a rectangular display frame for retaining the display material.

BRIEF SUMMARY OF THE INVENTION

The present invention is directed to an advertising display system which is mounted on top of a gasoline pump at a service station. The display system will typically be installed on every gas pump at the station. Each display system contains a plurality of display stations, for example two or three. A display module containing replaceable advertising information is removably installed at each display station. The display module includes a business card dispenser which is loaded with the business cards of the advertiser. The display system is positioned directly in front of people as they service their vehicles, and therefore provides an ideal advertising medium. Should a display module become damaged, it can simply be replaced. The display module consists of two spaced-apart layers of plexi glass. The ad is slid in between the layers. The sides and bottom of the layers are sealed to prevent the entrance of moisture. Additionally, the housing of the display system has bottom holes which provide drainage.

The business card dispenser is beneficial because when a potential customer sees an advertisement and is interested in the particular product or service, they can simply take one of the advertiser's business cards. In another embodiment of the invention, an information transfer device (side box) is provided at one side of the display system. The information transfer device contains a business card dispenser which contains the business cards of the owner of the display system, so that a potential advertising customer may contact the system owner to inquire about advertising his or her product or service. The information transfer device also contains a business card depository so that a potential advertising customer may deposit his or her business card in order to be contacted by the owner of the display system.

In accordance with a preferred embodiment of the invention, a display system for a gasoline pump includes a hollow housing having a plurality of display stations (segments), each display station having a window-like opening or aperture. A corresponding plurality of display modules are provided, wherein one display module is installable at each display station. The display modules each display a replaceable advertising sheet which may be viewed through a clear front panel. Each display module also includes a business card dispenser so that a potential customer may take the business card of the advertiser.

In accordance with another aspect of the invention, the housing of the display system includes a back panel which can be selectively opened and closed. When in the open position, the display module is inserted into the housing with the advertising information facing the aperture in the housing. A resilient (sponge-like) foam spacer is installed behind the display module before the back panel is closed. The resilient spacer urges the display module toward the aperture in the housing.

In accordance with another aspect of the invention the display module has a front transparent plate, a back plate, and a cavity disposed between the front transparent plate and the back plate, the cavity being shaped and dimensioned to removably receive an advertising sheet containing advertising information.

In accordance with another aspect of the invention, the business card dispenser is transparent so that the number of stacked business cards may be viewed in order to effect timely replacement.

In accordance with another aspect of the invention, either two or three display stations and display modules are provided.

In accordance with another aspect of the invention, an information transfer device is disposed at a side of the housing, the information transfer device having (1) a business card dispenser, and (2) a business card depository.

In accordance with another aspect of the invention, the business card depository includes an L-shaped bracket for removing deposited business cards therefrom.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 18 is a front elevation view of a second embodiment of the display system;

FIG. 19 is a side elevation view of the second embodiment;

FIG. 20 is a front elevation view of an information transfer device; and,

FIG. 21 is a side elevation view of the information transfer device.

DETAILED DESCRIPTION OF THE INVENTION

Figures 1, 2, 3, 4, 5:
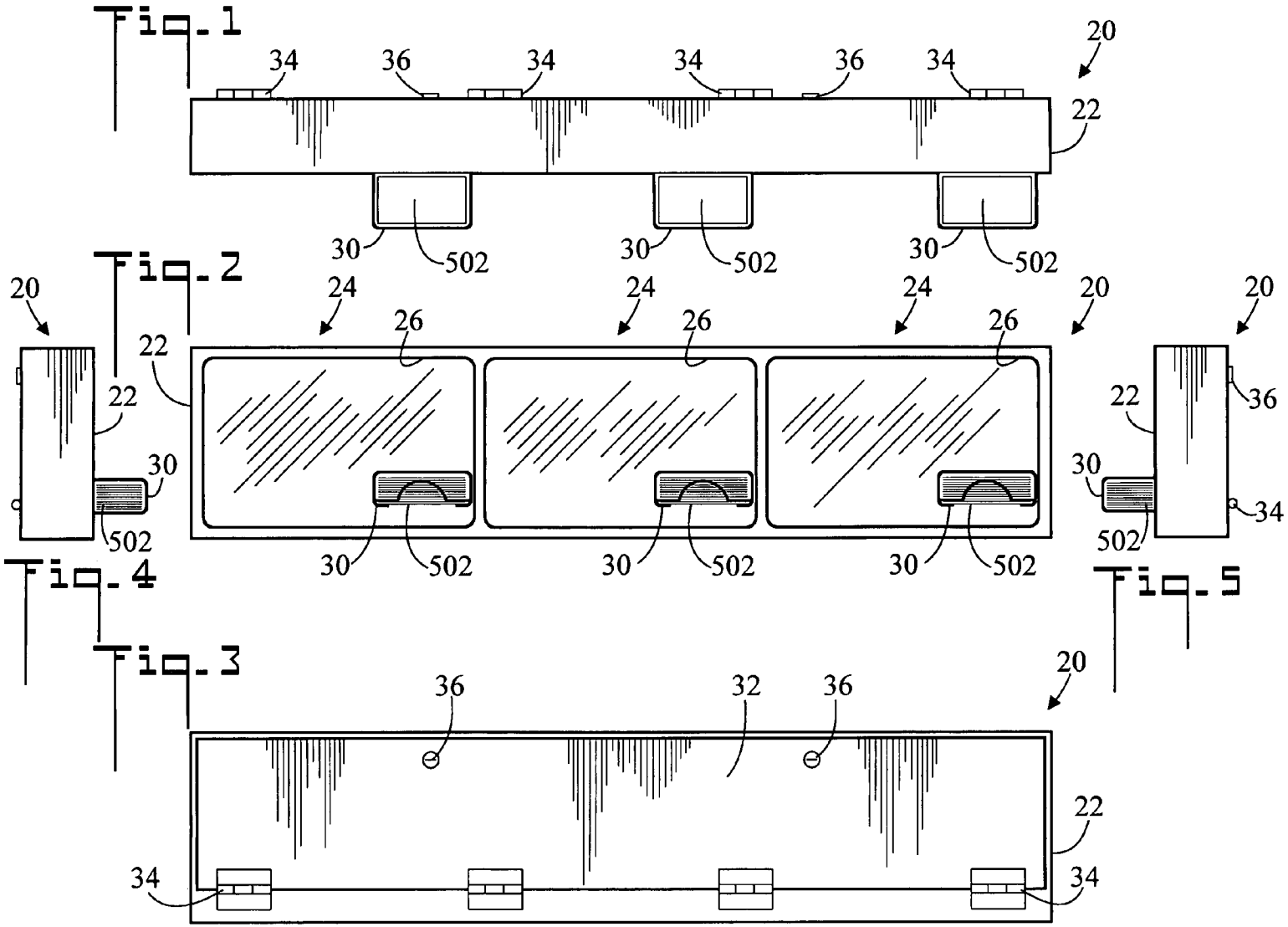
FIG. 1 is a top plan view of a display system for a gasoline pump.
FIG. 2 is a front elevation view of the display system.
FIG. 3 is a rear elevation view of the display system.
FIG. 4 is a side elevation view of the display system.
FIG. 5 is an opposite side elevation view of the display system.

Referring initially to FIGS. 1-6 and 17, there are illustrated top plan, front elevation, rear elevation, side elevation, opposite side elevation, bottom plan, and perspective views respectively of a display system for a gasoline pump 500, generally designated as 20. Display system 20 includes a hollow housing 22 having a plurality of display stations 24, each display station 24 having a window-like aperture 26. In an embodiment of the invention, display system 20 includes either two or three (shown) display stations 24. Display system 20 further includes a corresponding plurality of display modules 28, wherein one display module 28 is installable at each display station 24. Each display module 28 has a business card dispenser 30, wherein business cards 502 may be loaded into business card dispenser 30, and removed one at a time from a slot at the bottom of business card dispenser 30. Business cards 502 will typically provide contact information for the advertiser which is advertised on a display module 28 (refer to FIGS. 12 and 13). In an embodiment of the invention, business card dispenser 30 is fabricated from a transparent material so that the number of stacked business cards 502 may be conveniently viewed. This feature is useful in determining when business card dispenser 30 needs to be refilled with additional business cards 502. Display module 28 is installed at a display station 24 so that business card dispenser 30 protrudes through aperture 26, and is therefore readily positioned for customer view and access. In an embodiment of the invention, display system 20 includes either two or three (shown) display modules 28 which correspond with the two or three display stations 24.

Figures 6, 7, 8, 9, 10, 11:
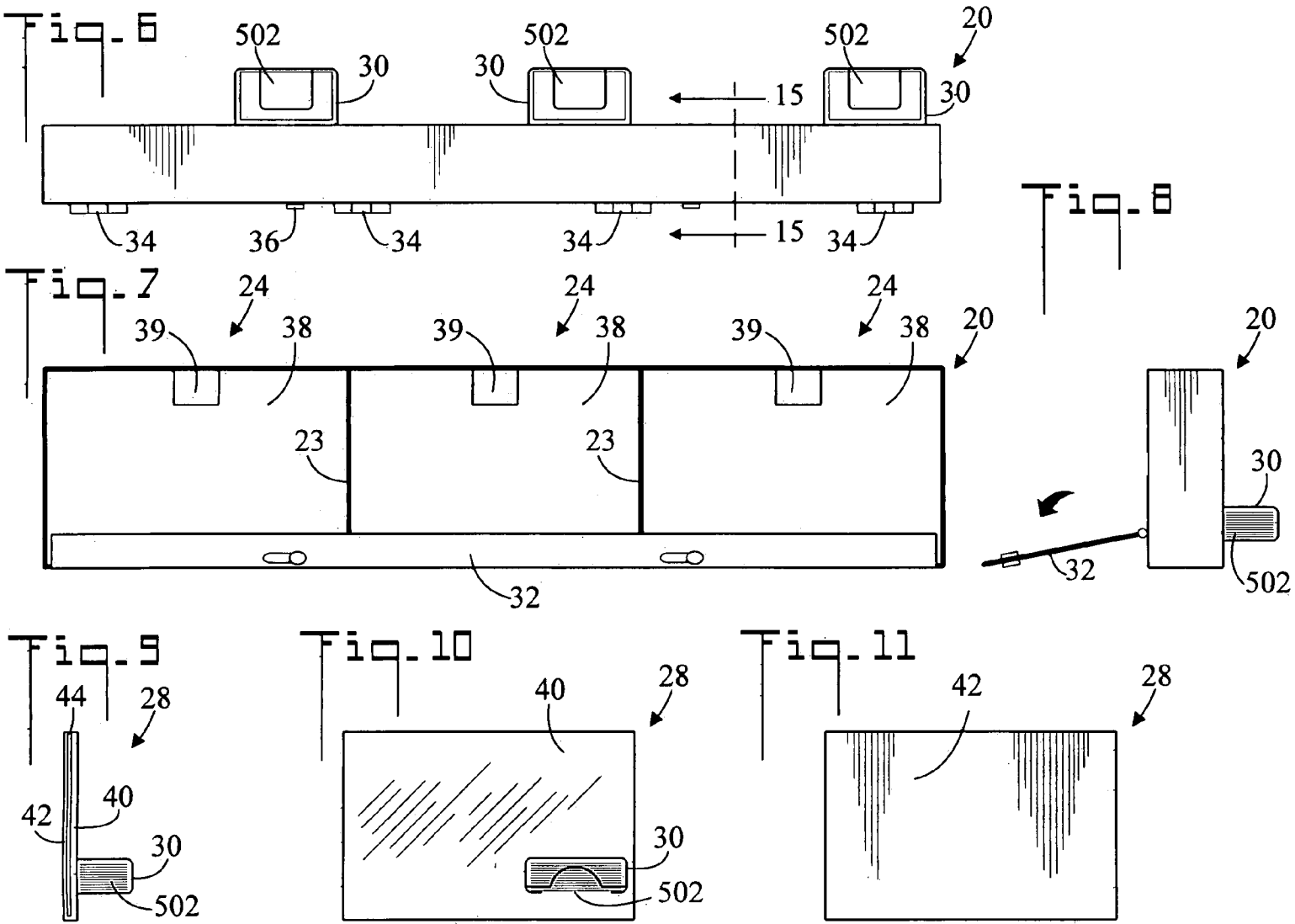
FIG. 6 is a bottom plan view of the display system.
FIG. 7 is a rear elevation view of the display system with a back panel in an open position.
FIG. 8 is a side elevation view of the display system with the back panel in an open position.
FIG. 9 is a side elevation view of a display module.
FIG. 10 is a front elevation view of the display module.
FIG. 11 is a rear elevation view of the display module.

Referring to FIGS. 7 and 8, housing 22 includes a back panel 32 which is selectively positionable to an open position (refer to FIG. 8) to allow display module 28 to be installed in and removed from display station 24, and to a closed position (refer to FIG. 3). Hinges 34 and locks 36 (refer to FIG. 3) effect the movement and locking of back panel 32. A resilient spacer 38 is installed between display module 28 and back panel 32, wherein spacer 38 urges display module 28 toward aperture 26 (refer also to FIGS. 14 and 15, and the discussions pertaining thereto). In an embodiment of the invention, resilient spacer 38 comprises a block of resilient polymer foam which has a cutout 39 to facilitate removal from housing 22. Partitions 23 separate display stations 24.

Figure 13:
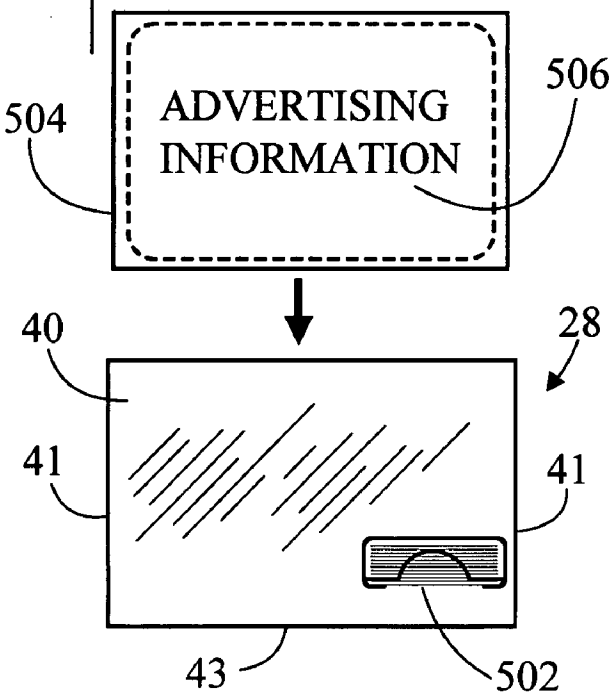
FIG. 13 is a front elevation view of the display module with the advertising being inserted.
Figure 12:
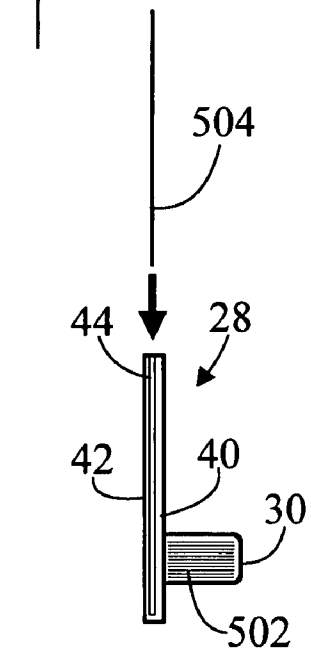
FIG. 12 is a side elevation view of the display module with an advertising sheet being inserted.

Referring now to FIGS. 9-11, there are illustrated side elevation, front elevation, and rear elevation views respectively of display module 28. Display module 28 has a front transparent plate 40 (such as of clear plastic), a back plate (42), and a cavity 44 disposed between front transparent plate 40 and back plate, 42. Referring also to FIGS. 12 and 13, cavity 44 is shaped and dimensioned to removably receive an advertising sheet 504 which contains advertising information indicia 506. Advertising sheet 504 is inserted into cavity 44 so that advertising information indicia 506 faces front transparent plate 40 and may be viewed therethrough.

FIGS. 12 and 13 are side elevation and front elevation views respectively of display module 28 with an advertising sheet 504 containing advertising information indicia 506 being inserted. In an embodiment of the invention, the sides 41 and bottom 43 of display module 28 are sealed to prevent the entry of moisture which could damage advertising sheet 504.

Figure 14:
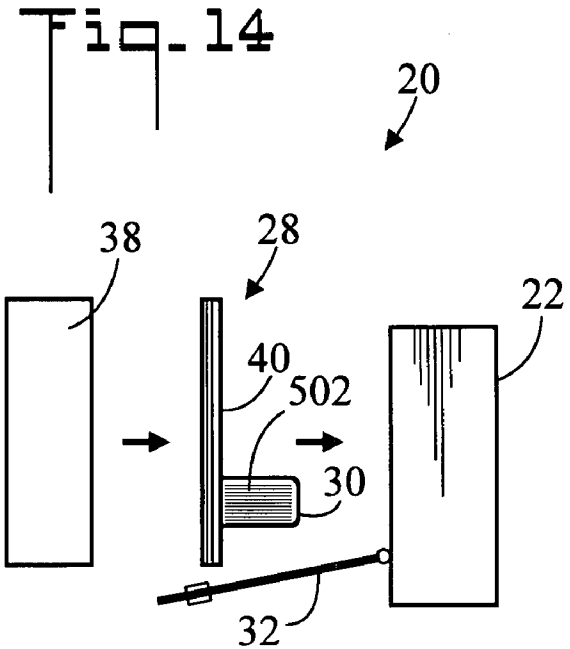
FIG. 14 is an exploded side elevation view showing the display module being inserted into a housing and a spacer being inserted in back of the display module.

FIG. 14 is an exploded side elevation view showing display module 28 being inserted into housing 22 and resilient spacer 38 being inserted in back of display module 28. Once the insertion is completed, back panel 32 is placed in the closed position as shown in FIG. 4.

Figure 15:
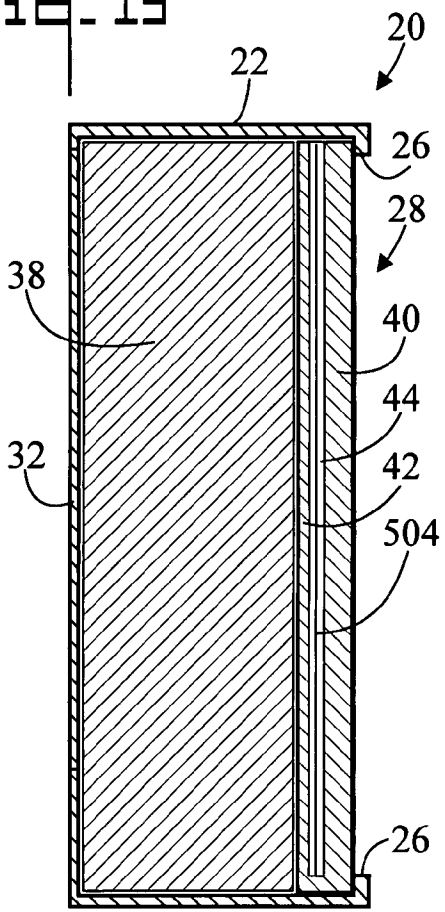
FIG. 15 is an enlarged cross sectional view along the line 15-15 of FIG. 6.

FIG. 15 is an enlarged cross sectional view along the line 15-15 of FIG. 6. With back panel 32 in the closed position, display module 28 is urged against aperture 26 by resilient spacer 38.

Figure 16:
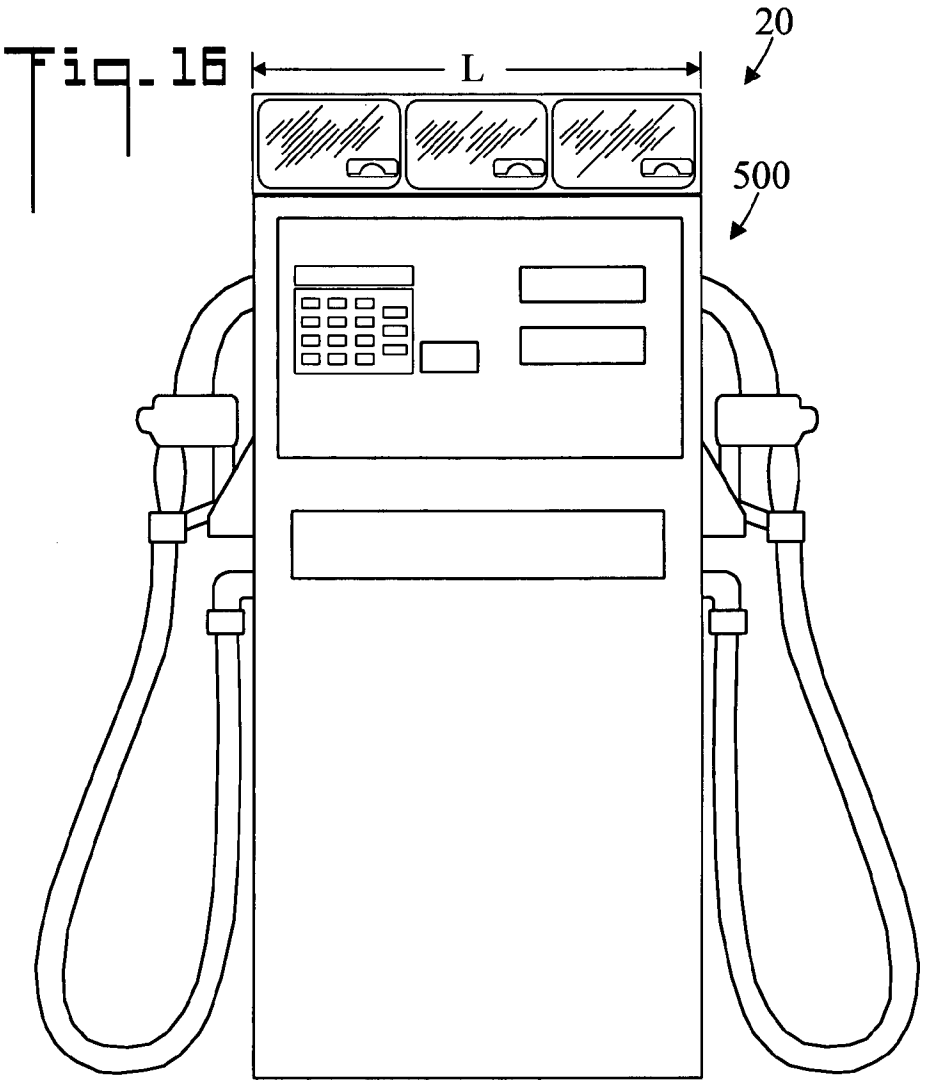
FIG. 16 is a front elevation view of the display system installed on the top of a gasoline pump.

FIG. 16 is a front elevation view of display system 20 installed on the top of gasoline pump 500. In an embodiment of the invention, the length L of display system 20 is substantially equal to the width of gas pump 500. In an embodiment of the invention, L is about 36.5 inches. In an embodiment of the invention, an adhesive (such as double-sided tape) is utilized to attach display system 20 to the top of gasoline pump 500.

Figure 17:
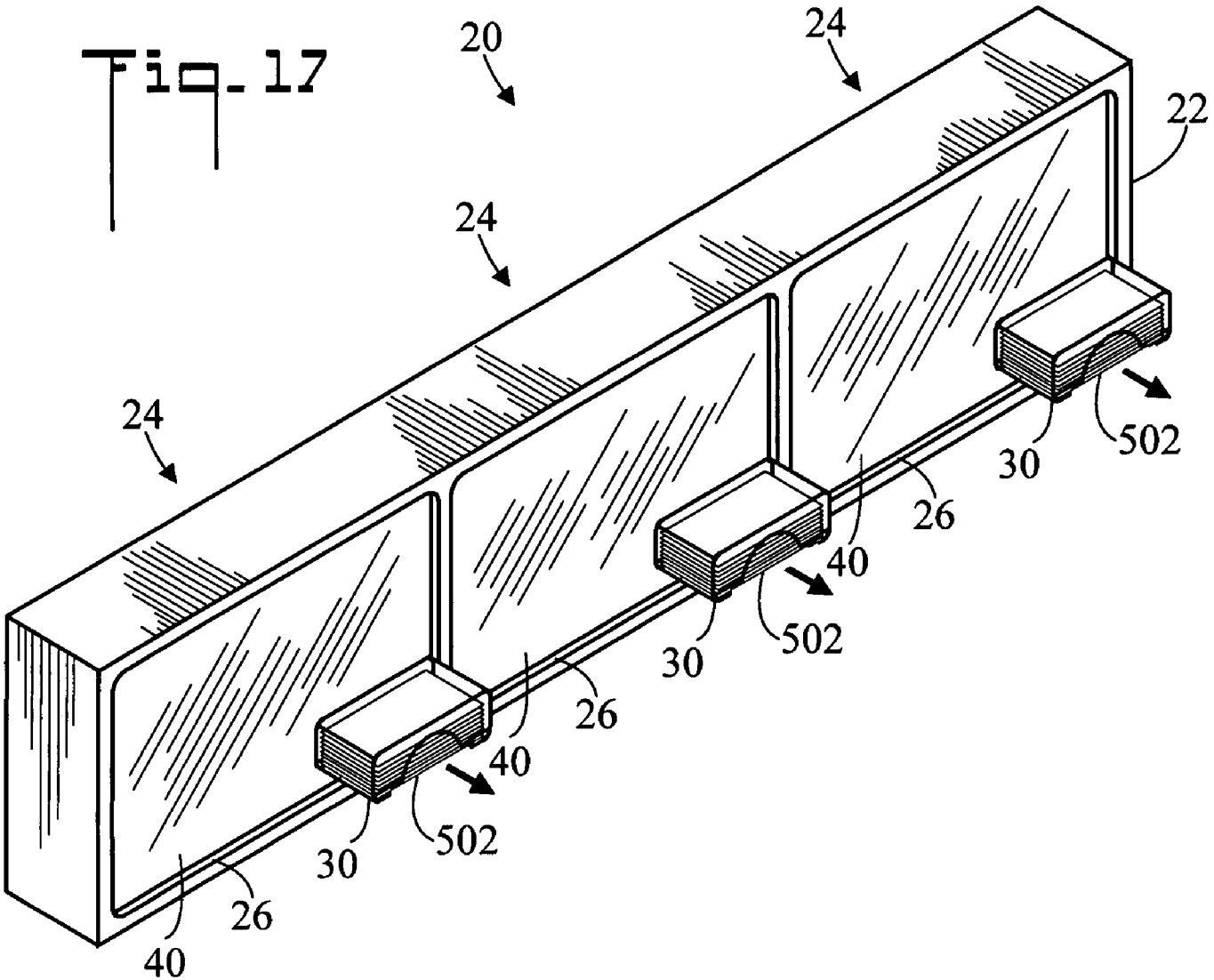
FIG. 17 is a perspective view of the display system.

FIG. 17 is a perspective view of display system 20.

FIGS. 18 and 19 are front elevation and side elevation views respectively of a second embodiment of the display system, generally designated as 120, and FIGS. 20 and 21 are front elevation and side elevation views respectively of an information transfer device 160. Information transfer device 160 is disposed at a side of housing 122 which is about 4.75 inches longer than housing 20 (refer to FIG. 2). Information transfer device 160 has (1) a business card dispenser 130, and (2) a business card depository 150. This embodiment allows potential advertising customers to drop their business card in slot 153 of business card depository 150, or take a business card from the owner of display system 120 from business card dispenser 130. In an embodiment of the invention, business card depository 150 includes a removable cover 151 and, once cover 151 is removed, an L-shaped bracket 152 is pulled up in direction 155 to remove deposited business cards therefrom. Information transfer device 160 mounts into housing 122 in a similar fashion as display module 28 mounts into housing 22, wherein a resilient spacer 138 is utilized to urge information transfer device 160 toward aperture 126.

In an embodiment of the invention, housing 22 (122), display module 28, and information transfer device 160 are fabricated from a polymer.

In terms of use, a method of advertising includes:

(a) providing a gasoline pump 500;

(b) providing a display system 20 for gasoline pump 500, including:

a housing 22 having a plurality of display stations 24, each display station 24 having an aperture 26;

a corresponding plurality of display modules 28, each display module 28 including a business card dispenser 30;

(c) installing one display module 28 at each display station 24 so that business card dispenser 30 protrudes through aperture 26; and, (d) installing display system 20 on gasoline pump 500.

The method further including:

in step (b), housing 22 including a back panel 32, back panel 32 selectively positionable to an open position and a closed position;

providing a resilient spacer 38;

prior to step (c), placing back panel 32 to the open position;

after step (c), installing resilient spacer 38 adjacent to display module 28; and, placing back panel 32 in the closed position wherein spacer 38 urges display module 28 toward aperture 26.

The method further including:

providing an advertising sheet 504;

in step (b), display module 28 having a front transparent plate 40, a back plate 42, and a cavity 44 disposed between front transparent plate 40 and back plate 42, cavity 44 shaped and dimensioned to removably receive advertising sheet 504; and, prior to step (c), inserting advertising sheet 504 into cavity 44.

The method further including:

a customer removing a business card 502 from business card dispenser 30.

The method further including:

in step (b), business card dispenser 30 being transparent; and, a system maintainer periodically observing business card dispenser 30 to ensure that it contains business cards 502.

The method further including:

in step (b), an information transfer device 160 attached to a side of housing 22, information transfer device 160 having (1) a business card dispenser 130, and (2) a business card depository 150;

a customer taking a card from business card dispenser 130; and, a customer depositing a business card 502 in business card depository 150.

The method further including:

in step (d), said installation effected by an adhesive.

The preferred embodiments of the invention described herein are exemplary and numerous modifications, variations, and rearrangements can be readily envisioned to achieve an equivalent result, all of which are intended to be embraced within the scope of the appended claims.

We claim:

1. A method of advertising, comprising:

(a) providing a gasoline pump;

(b) providing a display system for said gasoline pump, including:

a housing having a plurality of display stations, each said display station having an aperture;

a corresponding plurality of display modules, each said display module including a business card dispenser;

said housing including a back panel, said back panel selectively positionable to an open position to allow said display module to be installed from the back of said housing at said display station, and to a closed position;

a corresponding plurality of spacers;

(c) placing said back panel to said open position;

(d) installing a said display module from the back of said housing at a said display station so that said business card dispenser protrudes through said aperture;

(e) installing a said spacer adjacent to said display module;

(f) placing said back panel in said closed position wherein said spacer urges said display module toward said aperture; and, (g) installing said display system on said gasoline pump.

2. The method of claim 1, further including:

in step (b), each said spacer being fabricated from resilient polymer foam.

3. The method of claim 1, further including:

providing an advertising sheet;

in step (b), said display module having a front transparent plate, a back plate, and a cavity disposed between said front transparent plate and said back plate, said cavity shaped and dimensioned to removably receive said advertising sheet; and, prior to step (d), inserting said advertising sheet into said cavity.

4. The method of claim 1, further including:

in step (b), said display module having two sides and a bottom; and, said two sides and said bottom being sealed to prevent the entry of moisture.

5. The method of claim 1, further including:

in step (b) said back panel hingedly connected to said housing.

6. The method of claim 1, further including:

in step (b), an information transfer device attached to a side of said housing, said information transfer device having (1) a business card dispenser, and (2) a business card depository having a slot for receiving dropped business cards;

a customer taking a card from said business card dispenser; and, a customer depositing a business card in said slot of said business card depository.

7. The method of claim 6, further including:

in step (b), said business card depository including a L-shaped bracket for removing deposited business cards therefrom; and, pulling up said L-shaped bracket to remove the deposited business cards.

8. A display system for a gasoline pump, comprising:

a housing having a plurality of display stations, each said display station having an aperture;

a corresponding plurality of display modules, wherein one said display module is installable at each said display station, each said display module including a business card dispenser;

wherein a said display module may be installed at a said display station so that said business card dispenser protrudes through said aperture;

said housing including a back panel, said back panel selectively positionable to an open position to allow said display module to be installed from the back of said housing at said display station, and to a closed position; and, a spacer installed between said display module and said back panel, wherein said spacer urges said display module toward said aperture.

9. The display system according to claim 8, further including:

said spacer being fabricated from resilient polymer foam.

10. The display system according to claim 8, further including:

said display module having a front transparent plate, a back plate, and a cavity disposed between said front transparent plate and said back plate, said cavity shaped and dimensioned to removably receive an advertising sheet;

when said display module is installed at a said display station, said front transparent plate disposed between said back panel of said housing and said business card dispenser;

said display module having two sides and a bottom;

said two sides and said bottom being sealed to prevent the entry of moisture;

said plurality of display stations and said display modules being one of two and three;

said spacer being fabricated from resilient polymer foam; and said back panel hingedly connected to said housing.

11. The display system according to claim 10, further including:

an information transfer device disposed at a side of said housing, said information transfer device having (1) a business card dispenser, and (2) a business card depository having a slot for receiving dropped business cards; and, said business card depository including a L-shaped bracket for removing deposited business cards therefrom, wherein said L-shaped bracket is pulled up to remove the deposited business cards.

12. The display system according to claim 8, further including:

said back panel hingedly connected to said housing.

13. A display system for a gasoline pump, comprising:

a housing having a plurality of display stations and a back panel, each said display station having an aperture;

a corresponding plurality of display modules, wherein one said display module is installable at each said display station, each said display module including a business card dispenser;

wherein a said display module may be installed at a said display station so that said business card dispenser protrudes through said aperture;

said display module having a front transparent plate, a back plate, and a cavity disposed between said front transparent plate and said back plate, said cavity shaped and dimensioned to removably receive an advertising sheet; and, when said display module is installed at a said display station, said front transparent plate disposed between said back panel of said housing and said business card dispenser.

14. The display system according to claim 13, further including:

said display module having two sides and a bottom; and, said two sides and said bottom being sealed to prevent the entry of moisture.

* * * * *